United States Patent [19]

Grunz

[11] Patent Number: 4,490,875

[45] Date of Patent: Jan. 1, 1985

[54] PAINT BRUSH

[76] Inventor: James H. Grunz, 5080 Woodson Dr., Mission, Kans. 66202

[21] Appl. No.: 431,788

[22] Filed: Sep. 30, 1982

[51] Int. Cl.[3] ..... A46B 3/02

[52] U.S. Cl. ..... 15/143 R; 15/159 A; 15/192

[58] Field of Search ..... 15/159 R, 159 A, 160, 15/192, 193, DIG. 5, DIG. 6, 143 R

[56] References Cited

U.S. PATENT DOCUMENTS 2,406,732 8/1946 Hardman ..... 15/192
2,913,751 11/1959 Hardman et al. ..... 15/192

FOREIGN PATENT DOCUMENTS 884771 11/1971 Canada ..... 15/160
309419 4/1929 United Kingdom ..... 15/159

*Primary Examiner*—Harvey C. Hornsby
*Assistant Examiner*—Arthur D. Dahlberg

[57] ABSTRACT

This invention is directed to a paint brush for applying surface coatings. The invention has a handle with several holes to aid in the proper soaking of the bristles. Furthermore the bristles are of different lengths and colors to aid in the proper dipping of the bristles into the surface coating supply.

1 Claim, 2 Drawing Figures

PAINT BRUSH

This invention is for an improved paint brush for applying surface coatings in which the bristle assembly has natural and/or man made bristles of specific lengths and colors and the brush handle contains several strategically located holes such that this paint brush will have a longer useful life.

Most painters, professional and non-professional, severely reduce the life of paint brushes by improper use or cleaning. Several text books on correct painting techniques specifically state that the paint brush should be dipped into the paint supply no more than one-half the length of the bristles. Dipping the brush deeper results in the paint saturating the brush area nearest the brush ferrule, resulting in the potential for the paint to harden in an area of the brush that is difficult to clean. It is accordingly, one principal object of this invention to obviate such a problem by the provision of bristle colors and lengths that act as visual aids to reduce the tendency of painters to improperly dip the paint brush into a paint supply.

Realizing the possibility that a painter could accidentally dip a paint brush too deeply into the paint, another object of this invention is to provide a paint brush that can be cleaned effectively by proper soaking in an appropriate paint dissolver. The strategically located handle holes enable the painter to use a thin wire or rod to hang this invention in a number of common household containers filled with paint dissolver to the proper level, directly below the ferrule. Furthermore, these holes are located as to enable several different lengths of brush bristles to be soaked in the same container of dissolver on the same wire or rod.

Other important advantages or objects of this invention will become apparent from the disclosure in the specification and accompanying drawings, in which.

Figure 1:
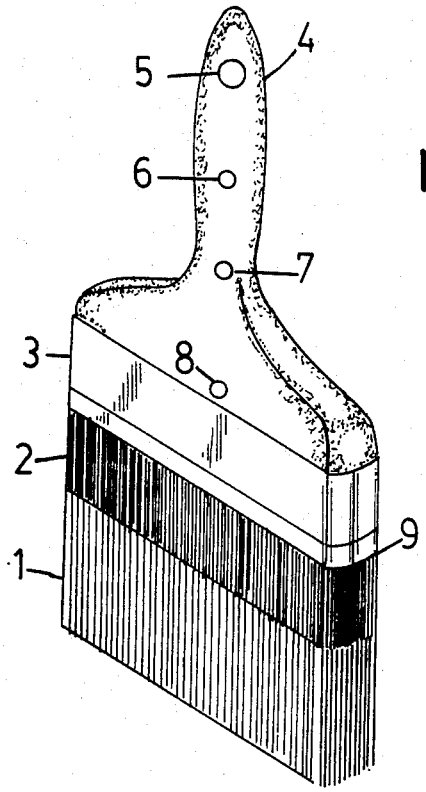
FIG. 1 is a perspective of the paint brush.
Figure 2:
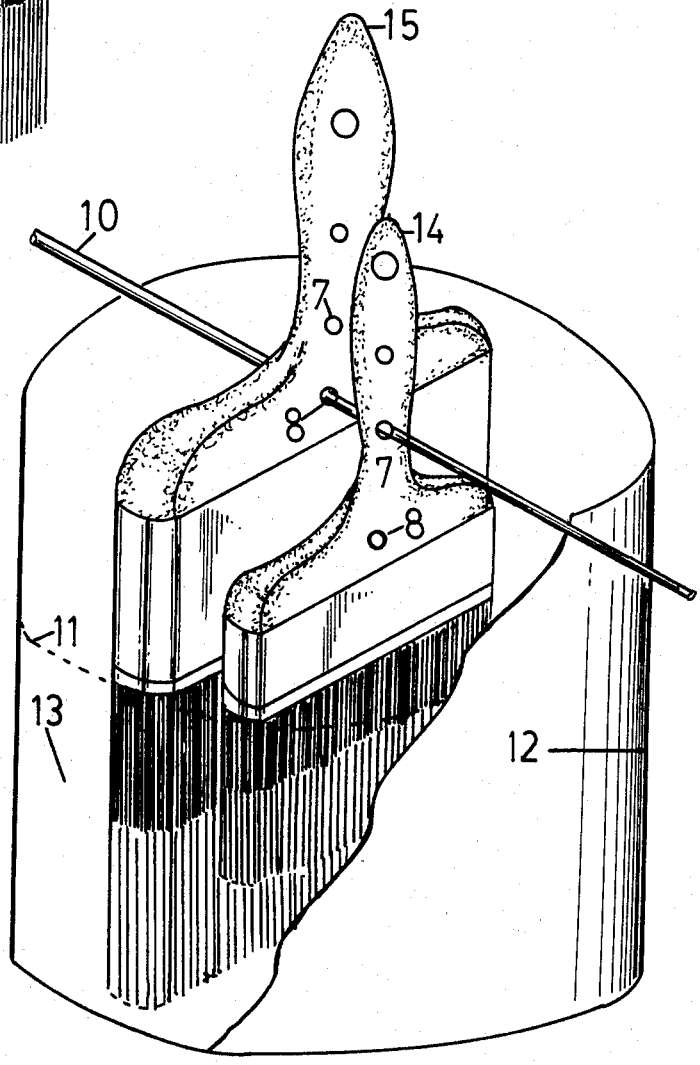
FIG. 2 is a sectional view showing two different sizes of this paint brush being soaked in paint cleaner dissolver.

Referring to FIG. 1, the main bristles 1 are approximately twice as long as the guide bristles 2. Furthermore, the guide bristles 2 are of a different color than the main bristles 1. For example, black main bristles 1 and white guide bristles 2 or white main bristles 1 and red guide bristles 2 would create a visual aid to help prevent the painter from dipping the brush too deeply into the paint supply. Based on some of the books cited, the proper way to clean paint hardened bristles 1 and 2 is to immerse the bristles 1 and 2 in paint dissolver 13. Current brush handle 4 designs have a single hole 5 located at the extreme end of the handle 4. Therefore, cleaning the bristles 1 and 2 would require using a very tall container 12, because the main bristles 1 while soaking should not be permitted to touch the bottom of the container 12 or the bristles 1 could become bent and consequently reduce or destroy their usefulness. For the purpose of illustration, holes 6 and 7 are positioned a distance from the ferrule bottom 9 that would enable bristle 1 and 2 soaking in a typical three pound and one pound coffee cans, respectively. Hole 8 is positioned for bristle 1 and 2 soaking in a Number 303 can commonly used as a one pound food can.

In general a larger paint brush 15 has longer bristles 1 and 2 and a longer handle 4. However, the proper level of paint dissolver is still just below the ferrule 9 regardless of the brush size. Therefore, to efficiently soak a large brush 15 and a small brush 14 at the same time in the same container 12, the rod 10 would be placed through hole 8 on the larger brush 15 and hole 7 in the smaller brush 14.

I do not propose herein to limit this invention to the specific embodiments described above except as necessitated by the principles and scope of the appended claims.

I claim:

1. A surface coating applicator comprising:

a tubular ferrule having a cluster of bristles inserted partway into one end, substantially to seal one end of said ferrule; a hardened mass of cured, resinous cement disposed atop said cluster of bristles in firm adhesive connection with portions of said cluster of bristles in said ferrule, and an integral handle including a gripping portion extending outwardly from the other end of said ferrule;

said handle being of ridged material and having a series of vertically aligned openings that extend through said handle such that a rod may be inserted completely through a selected opening;

said openings are located at specific distances from the one end of the ferrule into which the bristle cluster is inserted, such that said rod can be used to support one or more applicators of the same or differing length and/or size in a container of solvent, such that the level of solvent only covers the clusters of bristles of each applicator up to the said end of said ferrule for proper soaking and cleaning of all clusters of bristles;

said cluster of bristles being made of two bristle sub groups being distinctly different in bristle length and bristle color;

said first bristle subgroup being longer and used for applying the surface coatings;

said second bristle subgroup being significantly shorter and of a contrasting color to the first bristle subgroup, so as to reduce the possibility of a painter dipping the surface coatings applicator too deeply into the coatings supply container.

* * * * *

UNITED STATES PATENT AND TRADEMARK OFFICE

CERTIFICATE OF CORRECTION

PATENT NO. : 4,490,875

DATED : January 1, 1985

INVENTOR(S) : James H. Gruns

It is certified that error appears in the above-identified patent and that said Letters Patent is hereby corrected as shown below:

On the title page, the name of the inventor should read; --[76] Inventor: James H. Gruns-- instead of James H. Grunz Signed and Sealed this

*Third* Day of *September 1985*

[SEAL]

*Attest:*

DONALD J. QUIGG

*Attesting Officer* *Acting Commissioner of Patents and Trademarks - Designate*